US006531043B1

(12) United States Patent
Palaika

(10) Patent No.: US 6,531,043 B1
(45) Date of Patent: Mar. 11, 2003

(54) METHODS FOR ELECTROCOATING A METALLIC SUBSTRATE WITH A PRIMER-SURFACER AND ARTICLES PRODUCED THEREBY

(75) Inventor: Thomas Palaika, Cheswick, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 236 days.

(21) Appl. No.: 09/606,927

(22) Filed: Jun. 29, 2000

(51) Int. Cl.[7] ..... C25D 13/12
(52) U.S. Cl. ..... 204/484; 204/488
(58) Field of Search ..... 204/484, 488

(56) References Cited

U.S. PATENT DOCUMENTS

| | | | | |
|---|---|---|---|---|
| 3,455,806 A | | 7/1969 | Spoor et al. | 204/181 |
| 3,928,157 A | | 12/1975 | Suematsu et al. | 204/181 |
| 3,947,339 A | | 3/1976 | Jerabek et al. | 204/181 |
| 3,953,391 A | | 4/1976 | Dowbenko et al. | 260/29.6 TA |
| 3,984,299 A | | 10/1976 | Jerabek | 204/181 |
| 4,017,438 A | | 4/1977 | Jerabek et al. | 260/29.2 EP |
| 4,147,679 A | | 4/1979 | Scriven et al. | 260/29.2 TN |
| 4,208,262 A | | 6/1980 | Kubo et al. | 204/181 T |
| 4,220,679 A | | 9/1980 | Backhouse | 427/401 |
| 4,259,163 A | | 3/1981 | Suzuki et al. | 204/181 T |
| 4,333,807 A | | 6/1982 | Suzuki et al. | 204/181 T |
| 4,403,003 A | | 9/1983 | Backhouse | 427/407.1 |
| 4,891,111 A | | 1/1990 | McCollum et al. | 204/181.7 |
| 4,933,056 A | | 6/1990 | Corrigan et al. | 204/181.7 |
| 4,941,930 A | | 7/1990 | Charles et al. | 148/260 |
| 5,071,904 A | | 12/1991 | Martin et al. | 524/458 |
| 5,098,947 A | | 3/1992 | Metzger et al. | 524/507 |
| 5,196,485 A | | 3/1993 | McMonigal et al. | 525/327.3 |
| 5,238,506 A | | 8/1993 | Cape et al. | 148/262 |
| 5,275,707 A | * | 1/1994 | Yamada et al. | 204/484 |
| 5,401,790 A | | 3/1995 | Poole et al. | 524/199 |
| 5,653,790 A | | 8/1997 | Fotinos et al. | 106/14.12 |
| 5,663,240 A | | 9/1997 | Simeone et al. | 525/327.3 |
| 5,739,213 A | | 4/1998 | Freriks et al. | 525/438 |
| 5,760,107 A | | 6/1998 | Valko et al. | 523/404 |
| 5,811,198 A | | 9/1998 | Freriks et al. | 428/482 |
| 5,814,410 A | | 9/1998 | Singer et al. | 428/423.1 |
| 5,820,987 A | | 10/1998 | Kaufman et al. | 428/413 |
| 5,837,766 A | | 11/1998 | Metro et al. | 524/495 |
| 5,869,198 A | * | 2/1999 | Erne et al. | 204/488 |
| 5,908,912 A | | 6/1999 | Kollah et al. | 528/45 |
| 6,350,359 B1 | * | 2/2002 | Doebler et al. | 204/488 |

FOREIGN PATENT DOCUMENTS

| | | |
|---|---|---|
| GB | 1159390 | 7/1969 |
| JP | 54062242 | 5/1979 |
| JP | 59053694 | 3/1984 |
| JP | 62263999 | 11/1987 |
| WO | WO 98/07770 | 2/1998 |

OTHER PUBLICATIONS

G. Fettis, "Automotive Paints And Coatings", Verlag Chemie, Weinheim, 1995, pp. 61–64.*

* cited by examiner

*Primary Examiner*—Kishor Mayekar
(74) *Attorney, Agent, or Firm*—Deborah M. Altman

(57) ABSTRACT

A method for coating an article having Class A and non-Class A surfaces, e.g., a metal, automotive substrate, includes selectively electrodepositing a first coating material, e.g., a primer surfacer, upon at least a portion of the Class A surface and electrodepositing an anticorrosion material upon at least a portion of the non-Class A surface. An optional topcoat can be applied upon at least a portion of the Class A surface over the primer-surfacer.

14 Claims, No Drawings

METHODS FOR ELECTROCOATING A METALLIC SUBSTRATE WITH A PRIMER-SURFACER AND ARTICLES PRODUCED THEREBY

CROSS-REFERENCE TO RELATED APPLICATION

This application is related to U.S. application Ser. No. 09/606,268, entitled "Methods for Electrocoating a Metallic Substrate With a Topcoat and Articles Produced Thereby", by G. Webster et al. filed concurrently herewith by the same assignee and herein incorporated by reference.

FIELD OF THE INVENTION

This invention relates generally to methods for coating metallic substrates and, more particularly, to methods for applying electrodepositable coatings onto an automotive substrate using a reverse coating process.

BACKGROUND OF THE INVENTION

In the automotive industry, a conventional "reverse coating process" consists of applying a primer coat by powder coating or powder electrodeposition coating onto an article, baking the coated article to effect the hardening of the coating, subjecting the remaining uncoated portion to a second electrodeposition and then baking the article again to effect hardening of the second coating. A topcoat, e.g. a basecoat and a clearcoat, is applied to at least the electrocoated outer surface of the substrate to provide acceptable aesthetics.

U.S. Pat. No. 4,333,807 discloses a different reverse coating process in which, after an initial resin powder primer coating is applied to the substrate, the resin powder is heated to a temperature sufficient to melt the coating but not to cure the coating, i.e., to cause a cross-linking reaction. The first coating is sanded and then an electrodeposition coating is applied, after which the coated substrate is heated to a temperature sufficient to cross-link both coatings.

U.S. Pat. No. 4,259,163 discloses yet another method of reverse coating a substrate. A binder resin and synthetic resin in the form of fine powder in an aqueous bath is electrodeposited upon the substrate. Next, an ionic synthetic resin is electrodeposited upon the area of the substrate not covered by the first electrodeposited coating, and then the coated substrate is baked to simultaneously harden both coatings.

In known reverse coating processes, a topcoat is applied over the reverse coated substrate, typically over at least the outer facing portion of the substrate, to provide the substrate with an aesthetically acceptable finish.

It would be advantageous to provide a reverse coating process that permits selectively coating, particularly electrocoating, selected areas of the substrate with a primer-surfacer.

SUMMARY OF THE INVENTION

An aspect of the present invention is a coated metallic article having a Class A surface and a non-Class A surface, the article comprising a primer-surfacer electrodeposited upon at least a portion of the Class A surface, and an anticorrosion material electrodeposited upon at least a portion of the non-Class A surface. The primer-surfacer comprises a polyurethane, polyester, or acrylic polymer material.

The present invention also provides a coated metallic article having a Class A surface and a non-Class A surface; the article comprising a primer-surfacer electrodeposited upon at least a portion of the Class A surface, and an anticorrosion material electrodeposited upon at least a portion of the non-Class A surface. The primer-surfacer is essentially free of powder material.

The present invention further provides a method of coating a metallic article having a Class A surface and a non-Class A surface, the method comprising electrodepositing a primer-surfacer upon at least a portion of the Class A surface, and electrodepositing an anticorrosion material upon at least a portion of the non-Class A surface. The primer-surfacer is essentially free of powder material and/or comprises a polyurethane, polyester, or acrylic polymer material.

DESCRIPTION OF THE PREFERRED EMBODIMENTS

Other than in the operating examples, or where otherwise indicated, all numbers expressing quantities of ingredients, reaction conditions, and so forth used in the specification and claims are to be understood as being modified in all instances by the term "about". Also, as used herein, the term "polymer" is meant to refer to oligomers and both homopolymers and copolymers. Additionally, any numeric reference to amounts, unless otherwise specified in the document are "by weight", for instance, the phrase "solids of 34%" means "solids of 34% by weight".

The present invention is useful for coating metallic substrates, such as metallic automotive components designed for subsequent inclusion in an automotive vehicle, such as doors, hoods, fenders, bumpers, etc. As will be appreciated by one of ordinary skill in the automotive art, automotive substrates are conventionally referred to as having Class A and non-Class A surfaces. "Class A" surfaces are those surfaces which will become part of the most visible portions of the resulting vehicle, such as the outer portions of the door panels, hood, trunk, quarter panels, side panels, etc., which are exposed directly to the weather and are readily visible to the consumer. "Non-Class A" surfaces are those surfaces which are destined for non-highly visible areas or even non-visible areas of the vehicle, such as the inside of the door panel, inside surface of the quarter and side panels, underneath the hood or trunk, etc. Although an aesthetic, durable finish is required for the Class A surfaces, applying such aesthetic finishes onto the non-Class A surfaces is not desirable because such coatings are costly and time-consuming to apply. However, the non-Class A surfaces at least should be coated with an anticorrosion coating to prevent rust or corrosion.

The metallic substrates used in the practice of the present invention include ferrous metals, non-ferrous metals and combinations thereof. Suitable ferrous metals include iron, steel, and alloys thereof. Non-limiting examples of useful steel materials include cold rolled steel, galvanized (zinc coated) steel, electrogalvanized steel, stainless steel, pickled steel, GALVANNEAL, GALVALUME, and GALVAN zinc-aluminum alloys coated upon steel, and combinations thereof. Useful non-ferrous metals include aluminum, zinc, magnesium and alloys thereof. Combinations or composites of ferrous and non-ferrous metals can also be used.

Before depositing coatings upon the surface of the metallic substrate, it is preferred to remove foreign matter from the metal surface by thoroughly cleaning and/or degreasing the substrate surface. As used herein, the terms "deposited upon" and "provided upon" a substrate mean deposited or provided above or over but not necessarily adjacent to the surface of the substrate. For example, a coating can be deposited directly upon the substrate or one or more other coatings can be applied therebetween.

The surface of the metallic substrate can be cleaned by physical or chemical means, such as mechanically abrading the surface or cleaning/degreasing with commercially available alkaline or acidic cleaning agents which are well know to those skilled in the art, such as sodium metasilicate and sodium hydroxide. Non-limiting examples of preferred cleaning agents include CHEMKLEEN 163 and CHEMKLEEN 177 phosphate cleaners, both of which are commercially available from PPG Industries, Inc. of Pittsburgh, Pa.

Following the cleaning step, the surface of the metallic substrate may be rinsed with water, preferably deionized water, in order to remove any residue. Optionally, the metal surface can be rinsed with an aqueous acidic solution after cleaning with the alkaline cleaners. Examples of rinse solutions include mild or strong acidic cleaners such as the dilute nitric acid solutions commercially available and conventionally used in metal pretreatment processes. The metallic substrate can be air dried using an air knife, by flashing off the water by brief exposure of the substrate to a high temperature or by passing the substrate between squeegee rolls.

Optionally, a phosphate-based conversion coating can be applied to the metallic substrate. Suitable phosphate conversion coating compositions include those known in the art, such as zinc phosphate, optionally modified with nickel, iron, manganese, calcium, magnesium or cobalt. Useful phosphating compositions are described in U.S. Pat. Nos. 4,941,930; 5,238,506 and 5,653,790.

The substrate or portions thereof optionally can be coated with an anticorrosion pretreatment material, preferably an electroconductive zinc-rich epoxy-based pretreatment material, such as is disclosed in Application No. 09/469,259, now U.S. Pat. No. 6,312,812, herein incorporated by reference. A preferred anticorrosion coating includes EPON® 1009 epoxy-functional resin commercially available from Shell Chemical Company of Houston, Tex., zinc dust, salt of a sulfated castor oil derivative, silica, molybdenum disulfide, red iron oxide, toluene diisocyanate blocked with caprolactam, melamine resin, dipropylene glycol methyl ether, propylene glycol methyl ether acetate and cyclohexanone. Other preferred anticorrosion coatings include BONAZINC 3000 and 5000 zinc-rich, epoxy-resin containing weldable coatings, which are commercially available from PPG Industries, Inc.

In accordance with a preferred embodiment of the invention, the cleaned substrate is electrocoated with a first electrodepositable coating material as described below. This first electrodepositable coating material is preferably a primer-surfacer which may or may not contain coloring pigments and which provides or enhances the chip resistance of the first coating.

Since the general process of electrodeposition will be readily understood by one of ordinary skill in the art, it will not be discussed in any great detail herein. In a typical electrodeposition process, a metal substrate being treated, serving as an electrode, and an electrically conductive counter electrode are placed in contact with an ionic, electrodepositable composition. Upon passage of an electric current between the electrode and counter electrode while they are in contact with the electrodepositable composition, an adherent film of the electrodepositable composition will deposit in a substantially continuous manner on the metal substrate.

Electrodeposition is usually carried out at a constant voltage in the range of from about 1 volt to several thousand volts, typically between 50 and 500 volts. Current density is usually between about 1.0 ampere and 15 amperes per square foot (10.8 to 161.5 amperes per square meter) and tends to decrease quickly during the electrodeposition process, indicating formation of a continuous self-insulating film.

Although electrodeposition processes can be cationic or anionic, in the preferred practice of the invention, the metal substrate being treated preferably serves as a cathode, with the electrodepositable composition preferably being cationic.

In the practice of the invention, the substrate is positioned in the electrodeposition bath with the Class A surface facing the anode. The first coating material is deposited on the substrate at differing thickness depending on the distance of the substrate from the anode and the orientation of the substrate. Thus, during the first electrodeposition step, the Class A surface is coated by a thicker coating of the first coating material than the non-Class A surface. The non-Class A surface may be coated by a thinner layer of the first coating material or, more preferably, the substrate is positioned at sufficient distance from the anode such that at least portions of the non-Class A surface, preferably substantially the entire non-Class A surface, are not coated with the first coating material due to the distance of the substrate from the anode.

Useful electrodepositable coating compositions for the first coating material can include anionic or cationic (preferred) electrodepositable compositions well known to those skilled in the art. Such compositions may comprise one or more film-forming materials and crosslinking materials. Suitable film-forming materials for the formation of an electrodepositable primer-surfacer of the invention comprise polyurethane film-forming materials, acrylic film-forming materials, and/or polyester film forming materials, one or more of which can be used alone or in combination with an epoxy film-forming material. Although not currently preferred, the film-forming material can comprise an epoxy-functional material. The amount of film-forming material in the electrodepositable composition generally ranges from about 50 to about 95 weight percent on a basis of total weight solids of the electrodepositable composition.

Suitable acrylic film-forming materials are disclosed in U.S. application Ser. No. 09/309,850, now U.S. Pat. No. 6,168,868; U.S. Pat. No. 3,953,391, and British reference GB 1,159,390, which are each herein incorporated by reference. Suitable acrylic materials preferably include polymers derived from alkyl esters of acrylic acid and methacrylic acid such as are disclosed in U.S. Patent Nos. 3,455,806 and 3,928,157, which are incorporated herein by reference, along with crosslinking material as described below. An example of a suitable commercially available material is POWERCRON® 920 material commercially available from PPG Industries, Inc.

Suitable polyurethane film forming materials are disclosed in U.S. application Ser. No. 09/309,851, now U.S. Pat. No. 6,268,225 herein incorporated by reference. The term "polyurethane" as used herein is intended to include polyurethanes as well as polyureas, and poly(urethane-ureas). The polyurethene preferably contains a polymeric segment derived from an active hydrogen-containing polymer having a glass transition temperature of 0° C. or less and a number average molecular weight of 400–4000. The ionic polyurethane resin can be anionic or cationic, but preferably is cationic and the composition is cationically electrodepositable. The polyurethane should have a molecular weight (Mz) of less than 100,000, preferably less than 50,000 and most preferably from 10,000 to 40,000. However, for some applications, higher Tg and molecular weight material, or blends of low and high Tg and/or molecular weight materials may be used. The polyurethane also has active hydrogen functionality, i.e., hydroxyl, primary or secondary amine, and typically has an active hydrogen equivalent weight of 800 to 2500 grams per equivalent.

The polyurethane can be prepared from a polyisocyanate and an active hydrogen-containing material. Suitable polyisocyanates used for preparing the polyurethanes include those that have aliphatically, cycloaliphatically, araliphatically, and/or aromatically bound isocyanate groups. The amount of polyisocyanate used to make the polyurethanes is typically from 10 to 60, preferably 20 to 50 percent by weight based on total weight of the reactants used to make the polyurethane.

The active hydrogen-containing material for reaction with the polyisocyanate to form a cationic or anionic polyurethane comprises one or more active hydrogen-containing polymers. These materials preferably have an average active hydrogen functionality ranging from about 2 to 8, preferably from about 2 to 4, and a number average molecular weight ranging preferably from about 400 to 10,000, more preferably from 400 to 4,000, and a glass transition temperature (Tg) of 0° C. or less. However, for some applications, higher Tg and molecular weight material, or blends of low and high Tg and/or molecular weight materials may be used.

Examples of suitable active hydrogen-containing materials include polyether polyols such as polyalkylene ether polyols. Also, other polyethers obtained from the oxyalkylation of various polyols can be used. One commonly utilized oxyalkylation method is by reacting a polyol with alkylene oxide such as ethylene or propylene oxide in the presence of an acidic or basic catalyst.

Mixed polyoxyalkylenepolyamines can be used, that is, those in which the oxyalkylene group can be selected from more than one moiety. Derivatives of polyoxyalkylenepolyamines may also be usable. Examples of suitable derivatives would be aminoalkylene derivatives which are prepared by reacting polyoxyalkylenepolyamines with acrylonitrile followed by hydrogenation of the reaction product.

The above reference for the polyols is not inclusive, and many materials with multiple hydroxyl functionality may be used. These include, but are not limited to, materials which the main backbone is aliphatic, aromatic, organometallic, or combinations of the above. Functionality other than hydroxyl may be included along the backbone of the polyol as long as it does not interfere with the reaction of the isocyanate with the hydroxyl.

For cationic polyurethanes, the ionizable moiety is typically a tertiary amine group that can be incorporated into the polyurethane by reaction with an active hydrogen-containing compound. The amine is neutralized with acid to form the amine salt groups. Suitable amine compounds include aminoalcohols, diethylaminopropylamine, hydroxyalkylmorpholine, and hydroxyalkylpiperazine, and the like and mixtures thereof. The amount of amine introduced into the polymer typically is that sufficient to give 0.1 to 1, preferably 0.2 to 0.5 milliequivalents (meqs) of amine per gram of resin solids as determined by titration. Suitable neutralizing agents include organic acids such as acetic acid, hydroxyacetic acid, propionic acid, lactic acid, formic acid, tartaric acid, sulfamic acid and dimethylolpropionic acid, as well as inorganic acids such as sulfuric acid, hydrochloric acid and phosphoric acid.

To achieve optimum chip resistance and durability, the polyurethane preferably is curable or thermosetting. As such, it is used with a curing or crosslinking agent such as a capped or blocked isocyanate, which is preferred for cationic compositions, or an aminoplast, which is preferred for anionic compositions.

The polyisocyanate may be fully capped with essentially no free isocyanate groups and present as a separate component or it may be partially capped and reacted with hydroxyl or amine groups in the polyurethane backbone. Examples of suitable polyisocyanates and capping agents are described in U.S. Pat. No. 3,947,339, herein incorporated by reference.

When the crosslinking agent used with the polyurethane material contains free isocyanate groups, the film-forming composition is preferably a two-package composition (one package comprising the crosslinking agent and the other comprising the hydroxyl functional polymer) in order to maintain storage stability. Fully capped polyisocyanates are described in U.S. Pat. No. 3,984,299.

The polyisocyanate can be an aliphatic, cycloaliphatic or an aromatic polyisocyanate or a mixture of the two.

Any suitable aliphatic, cycloaliphatic, or aromatic alkyl monoalcohol or phenolic compound may be used as a capping agent for the capped polyisocyanate crosslinking agent in the composition of the present invention e.g., oximes such as methyl ethyl ketoxime, acetone oxime and cyclohexanone oxime, lactams such as epsilon-caprolactam, and amines such as dibutyl amine.

For polyurethane materials, the crosslinking agent is typically present in an amount of at least 10 percent by weight, preferably at least 15 percent by weight, based on total resin solids weight of the composition. The crosslinking agent is also typically present in an amount of less than 60 percent by weight, preferably less than 50 percent by weight, and more preferably less than 40 percent by weight, based on total resin solids weight of the composition. The amount of crosslinking agent present may range between any combination of these values, inclusive of the recited values.

The equivalent ratio of hydroxyl groups in the polymer to reactive functional groups in the crosslinking agent is typically within the range of 0.5 to 2.0, preferably 1.0 to Usually the polyurethane composition preferably contains catalysts to accelerate the cure of the crosslinking agent with reactive groups on the polymer(s). The catalyst is usually present in an amount of about 0.05 to about 5.0 percent by weight, preferably about 0.08 to about 2.0 percent by weight, based on the total weight of resin solids in the thermosetting composition.

Examples of suitable polyester film forming materials are disclosed in U.S. Pat. Nos. 5,739,213 and 5,811,198 and in U.S. application Ser. No. 09/531,807, now U.S. Pat. No. 6,623,776, which patents and application are herein incorporated by reference. An exemplary polyester polymer suitable for the practice of the invention comprises the reaction product of an aromatic and/or cycloaliphatic carboxylic acid compound comprising at least two aromatic and/or secondary aliphatic carboxyl groups, or an anhydride thereof; a branched aliphatic, cycloaliphatic or araliphatic compound containing at least two aliphatic hydroxyl groups, the aliphatic hydroxyl groups being either secondary or tertiary hydroxyl groups or primary hydroxyl groups attached to a carbon adjacent to a tertiary or quaternary carbon; a compound comprising an ionic salt group or a group which is converted to an ionic salt group; and optionally, at least one hydroxyl substituted carboxylic compound comprising at least one tertiary aliphatic carboxyl group and at least two aliphatic hydroxyl groups. Preferably, the ionic salt group equivalent weight of the polyester polymer is between 1,000 and 10,000.

The salt group can confer either an overall positive or negative charge to the ionic polyester polymer. However, as discussed above, the material is preferably cationic. A compound which is "a compound comprising an ionic salt group" is a compound which includes the ionic salt group prior to polymerization. A "compound comprising a group which is converted to an ionic salt group" is a compound which, when reacted with another compound, forms a salt group.

Cationic salt groups can be either present before polymerization or they can be later formed. For electrodeposition, the cationic salt group is typically a quaternary ammonium group, and amine salt group or a sulfonium group. A method for forming quaternary amine groups in a cationic resin is described in U.S. Pat. No. 5,908,912. A method for forming amine salt groups is described in U.S. Pat. No. 4,017,438.

Suitable polyesters for use as precursor compounds to the ionic polyester polymer of the present invention are described in U.S. Pat. Nos. 5,739,213 and 5,811,198, herein incorporated by reference and described above.

The ionic polyester polymer preferably contains at least one functional group that is reactive with a curing agent. Typically, the reactive functional group is an active hydrogen group, as described in U.S. Pat. No. 5,908,912, which is most preferably a hydroxyl group. In the case of cationic embodiments of the resins, a hydroxyl group is present on the polyester polymer as a result of the opening of the epoxy ring during formation of the cationic groups.

Preferably, the ionic polyester includes active hydrogens which are generally reactive with curing agents for transesterification, transamidation, and/or transurethanization with isocyanate and/or polyisocyanate curing agents under coating drying conditions. Preferably, the ionic polyester polymer will have an active hydrogen content of 0.5 to 10 milliequivalents, more preferably 1.0 to 5 milliequivalents of active hydrogen per gram of resin solids.

Curing agent(s) for the polyester material useful in the present invention can be a polyisocyanate curing agent (such as discussed above) which is preferred for use with cationic polyester polymers or an aminoplast curing agent which is preferred for use with anionic polymers.

The curing agent is typically present in amounts of 25 to 45, preferably 30 to 35 percent by weight based on weight of main vehicle resin solids.

The polyester resin described above preferably is present in the electrocoating composition in amounts of about 1 to about 60 percent by weight, preferably about 5 to about 25 based on total weight of the electrodeposition bath.

Aqueous polyester compositions of the present invention typically are in the form of an aqueous dispersion, i.e., a two-phase transparent, translucent or opaque resinous system in which the resin is in the dispersed phase and the water is in the continuous phase. The average particle size of the resinous phase is generally less than 1.0 micron and usually less than 0.5 micron, preferably less than 0.15 micron. The concentration of the resinous phase in the aqueous medium is at least 1 and usually from about 2 to about 60 percent by weight based on total weight of the aqueous medium. When the compositions of the present invention are in the form of resin concentrates, they generally have a resin solids content of about 20 to about 60 percent by weight based on weight of the aqueous medium.

Suitable epoxy-functional materials are disclosed in U.S. application Ser. No. 09/309,850, now U.S. Pat. 6,168,868 herein incorporated by reference. The epoxy-functional materials preferably contain at least one, and more preferably two or more, epoxy or oxirane groups in the molecule, such as di- or polyglycidyl ethers of polyhydric alcohols. Useful polyglycidyl ethers of polyhydric alcohols can be formed by reacting epihalohydrins with polyhydric alcohols in the presence of an alkali condensation and dehydrohalogenation catalyst. Suitable polyhydric alcohols can be aromatic, aliphatic, or cycloaliphatic. Suitable epoxy-functional materials preferably have an epoxy equivalent weight ranging from about 100 to about 2000, as measured by titration with perchloric acid using methyl violet as an indicator. Useful polyepoxides are disclosed in U.S. Pat. No. 5,820,987 at column 4, line 52 through column 6, line 59, which is incorporated by reference herein. To form a cationic resin or composition, the epoxy-functional material can be reacted with an amine to form cationic salt groups, for example with primary or secondary amines which can be acidified after reaction with the epoxy groups to form amine salt groups or tertiary amines which can be acidified prior to reaction with the epoxy groups and which after reaction with the epoxy groups form quaternary ammonium salt groups. Other useful cationic salt group formers include sulfides. The material can be used in combination with a polyisocyanate curing agent that is at least partially capped with a capping agent.

The polyepoxide may be chain extended by reacting together a polyepoxide and a polyhydroxyl group-containing material selected from alcoholic hydroxyl group-containing materials and phenolic hydroxyl group-containing materials to chain extend or build the molecular weight of the polyepoxide. Examples of phenolic hydroxyl group-containing materials are polyhydric phenols, such as Bisphenol A, Bisphenol F, resorcinol, Hexane Diol, 1,3 cyclohexanediol,polycaprolactone diol, polyether diols, propoxylated Bisphenol A, ethoxylated Bisphenol A, Butane diols, Hydroquinone, Catechol, Hydantoin, and other dialcohols. The resin contains cationic salt groups and active hydrogen groups selected from aliphatic hydroxyl and primary and secondary amino.

A chain extended polyepoxide is typically prepared by reacting together the polyepoxide and polyhydroxyl group-containing material neat or in the presence of an inert organic solvent such as a ketone, including methyl isobutyl ketone and methyl amyl ketone, aromatics such as toluene and xylene, and glycol ethers such as the dimethyl ether of diethylene glycol. The reaction is usually conducted at a temperature of about 80° C. to 160° C. for about 30 to 180 minutes until an epoxy group-containing resinous reaction product is obtained. The equivalent ratio of reactants; i. e., epoxy:polyhydroxyl group-containing material is typically from about 1.00:0.75 to 1.00:2.00.

The polyepoxide can also contain cationic salt groups. The cationic salt groups are preferably incorporated into the resin by reacting the epoxy group-containing resinous reaction product prepared as described above with a cationic salt group former. By "cationic salt group former" is meant a material which is reactive with epoxy groups and which can be acidified before, during, or after reaction with the epoxy groups to form cationic salt groups. Examples of suitable materials include amines or sulfides which can be mixed with acid prior to reaction with the epoxy groups and form ternary sulfonium salt groups upon subsequent reaction with the epoxy groups.

The extent of cationic salt group formation should be such that when the resin is mixed with an aqueous medium and the other ingredients, a stable dispersion of the electrodepositable composition will form. By "stable dispersion" is meant one that does not settle or is easily redispersible if some settling occurs. Moreover, the dispersion should be of sufficient cationic character that the dispersed particles will migrate toward and electrodeposit on a cathode when an electrical potential is set up between an anode and a cathode immersed in the aqueous dispersion.

Generally, the cationic resin is non-gelled and contains from about 0.1 to 3.0, preferably from about 0.1 to 0.7 millequivalents of cationic salt group per gram of resin solids. The number average molecular weight of the cationic polyepoxide preferably ranges from about 2,000 to about 15,000, more preferably from about 5,000 to about 10,000. By "non-gelled" is meant that the resin is substantially free from crosslinking, and prior to cationic salt group formation, the resin has a measurable intrinsic viscosity when dissolved in a suitable solvent. In contrast, a gelled resin, having an essentially infinite molecular weight, would have an intrinsic viscosity too high to measure.

Active hydrogens associated with the cationic polyepoxide may include any active hydrogens which are reactive with isocyanates within the temperature range of about 93 to 204° C., preferably about 121 to 177° C. Preferably, the polyepoxide will have an active hydrogen content of about 1.7 to 10 millequivalents, more preferably about 2.0 to 5 millequivalents of active hydrogen per gram of resin solids. The term "active hydrogen" means those groups which are reactive with isocyanates as determined by the Zerewitnoff test as is described in the JOURNAL OF THE AMERICAN CHEMICAL SOCIETY, Vol. 49, page 3181 (1927). Preferably, the active hydrogens are hydroxyl, primary amine and secondary amine.

Beta-hydroxy ester groups may be incorporated into the polyepoxide by ring opening 1,2-epoxide groups of the polyepoxide with a material which contains at least one carboxylic acid group. Phenolic hydroxyl groups may be incorporated into the polyepoxide by using a stoichiometric excess of the polyhydric phenol during initial chain extension of the polyepoxide.

When the polyepoxide contains both phenolic hydroxyl groups and beta-hydroxy ester groups, the phenolic hydroxyl groups may be incorporated simultaneously with the beta-hydroxy ester groups, or sequentially before or after. The electrodepositable composition may further include additional ingredients having beta-hydroxy ester and/or phenolic hydroxyl groups, as well as customary auxiliaries typically used in electrodepositable compositions. Such electrodepositable compositions are described in WO 98/07770.

Crosslinking materials for the first electrodepositable coating composition may comprise blocked or unblocked polyisocyanates such as are described above. The amount of the crosslinking material in the electrodepositable coating composition generally ranges from about 5 to about 50 weight percent on a basis of total resin solids weight of the electrodepositable coating composition.

The electrodepositable coating composition also can comprise one or more pigments which can be incorporated in the form of a paste, surfactants, wetting agents, catalysts, film build additives, flatting agents, defoamers, microgels, pH control additives and volatile materials such as water and organic solvents, as described in U.S. Pat. No. 5,820,987 at column 9, line 13 through column 10, line 27. Suitable pigments include hiding pigments such as titanium dioxide, zinc oxide, antimony oxide, etc. and organic or inorganic UV opacifying pigments such as iron oxide, transparent red or yellow iron oxide, carbon black, phthalocyanine blue, and the like. Pigments can be present in amounts of up to 60 parts by weight or less based on 100 parts by weight of total solids of the electrodepositable composition. Useful solvents included in the composition, in addition to any provided by other coating components, include coalescing solvents such as hydrocarbons, alcohols, esters, ethers and ketones. Preferred coalescing solvents include alcohols, polyols, ethers and ketones. The amount of coalescing solvent is generally about 0.05 to about 5 weight percent on a basis of total weight of the electrodepositable coating composition.

Other optional ingredients are anti-oxidants, UV-absorbers and hindered amine light stabilizers. These ingredients are typically added in amounts up to about 4% based on the total weight of resin solids of the electrodepositable composition.

In addition to the specific electrodepositable coatings described above, examples of other useful commercially available electrodepositable coatings include POWERCRON® series coatings, such as but not limited to POWERCRON® 290, 390, 395, 756, 920, and 930 acrylic coating materials, commercially available from PPG Industries, Inc. Other useful electrodepositable coating compositions are disclosed in U.S. Pat. Nos. 4,891,111; 5,760,107 and 4,933,056, which are incorporated herein by reference. The solids content of the liquid electrodepositable coating composition generally ranges from about 3 to about 75 weight percent, and preferably about 5 to about 50 weight percent.

In a preferred embodiment of the invention, the first coating material functions as a primer-surfacer and preferably comprises a polyurethane film-forming material, an acrylic film-forming material, and/or a polyester film-forming material. An epoxy-functional film-forming material also can be used in combination with the polyurethane, acrylic, or polyester film-forming materials. The first electrodepositable material preferably is also free or essentially free of powder material, e.g., preferably has less than about 5 weight percent powder based on the total weight of the material.

After deposition of the first electrodepositable coating material, the coated substrate is removed from the bath and then optionally dried or set, e.g., using an infrared, electric or gas (direct or indirect) oven. Next, the coated substrate is positioned in the bath with the Class A surface again facing the anode. However, in this second electrodeposition process, uncoated or non-Class A surfaces of the substrate are electrocoated with a second, corrosion-inhibiting, electrodepositable coating composition preferably having a higher throwpower than the first electrodepositable coating composition. In the practice of the invention, the second coating composition is different from the first coating composition. By "different" is meant that the second coating composition is chemically different or has different components or amounts of components than the first coating composition. Due to the higher throwpower of the second coating material, the portions of the non-Class A surface which were not covered by the first coating material will be covered by the corrosion resistant second coating material. In a preferred practice of the invention, the second material comprises a clear, cationic resin liquid material and can be similar in composition to the coating materials described above for the first electrodepositable coating material. The second coating material can be a clear or pigmented material. Examples of useful commercially available electrodepositable coatings include POWERCRON® series coatings, such as but not limited to POWERCRON® 290, 390, 395, 756, 920, and 930 coating materials, commercially available from PPG Industries, Inc. As discussed above, the second coating is different than the first coating. Therefore, if, for example, POWERCRON® 290 coating material is used in the first coating, a different POWERCRON® coating material will be used in the second coating. The substrate is electrocoated to provide a thickness of the second coating material on the non-Class A surface of about 12.2 microns to about 36.8 microns (0.5 mils to 12.2 mils).

The coated substrate is then removed from the bath and the coating may then be flashed, set, or baked and may then be topcoated, e.g., conventionally topcoated. For example, a conventional basecoat material may be applied over at least a portion of the coated substrate, e.g., the Class A surface, in conventional manner. The basecoated substrate can be flashed or cured and a clearcoat applied over the basecoat in conventional manner. The topcoated substrate is then flashed and/or baked at a temperature sufficient to cure the electrodepositable coating materials and/or topcoat materials, e.g., baked at about 130° C. to about 177° C. for about 25 mins. to about 35 mins.

The topcoat may be formed in any convenient manner and can comprise a single coating (monocoat) formed from waterborne or solventborne liquid coating materials, powder slurries, or powder. Alternatively, the topcoat can be formed from a composite of multiple coating layers, such as one or more layers of effect pigmented, optionally colored, basecoats and/or one or more layers of non-effect pigmented, optionally tinted, transparent or translucent coatings or "clearcoat". In a preferred embodiment, the topcoat material is a powder material.

A powder monocoat can be applied to the Class A surface(s) of the substrate as a topcoat. The powder coating can be applied by electrostatic spraying using a gun or bell at 60 to 80 kV, 80 to 120 grams per minute to achieve a film thickness of about 50–90 microns, for example.

Preferably, the powder coating composition is a crosslinkable coating comprising at least one thermosettable film-forming material and at least one crosslinking material such as are described herein. The powder coating composition can include additives such as are discussed herein, and optionally pigments. Suitable powder coatings are described in U.S. Pat. No. 5,663,240 (incorporated by reference herein) and include epoxy functional acrylic copolymers and polycarboxylic acid crosslinking agents. The powder coatings typically have a cure temperature range of about 120° C. to about 172° C. The amount of the topcoat composition applied to the substrate can vary based upon such factors as the type of substrate and intended use of the substrate, i.e., the environment in which the substrate is to be placed and the nature of the contacting materials. Such powder coatings are preferably applied to a thickness of about 25.4 microns to about 127 microns (1 mil to 6 mils).

Alternatively, a basecoat/clearcoat coating can be applied upon at least a portion of the Class A surface. The basecoating composition can comprise a film-forming material or binder, and optionally volatile material and/or pigment. Preferably, the basecoating composition comprises a crosslinkable coating composition comprising at least one thermosettable film-forming material, such as acrylics, polyesters (including alkyds), polyurethanes and epoxies, and at least one crosslinking material. The amount of film-forming material in the liquid basecoat generally ranges from about 40 to about 97 weight percent on a basis of total solids of the basecoating composition. The amount of crosslinking material in the basecoat coating composition generally ranges from about 5 to about 50 weight percent on a basis of total resin solids weight of the basecoat coating composition.

Suitable acrylic film-forming polymers include copolymers of one or more of acrylic acid, methacrylic acid and alkyl esters thereof, such as methyl methacrylate, ethyl methacrylate, hydroxyethyl methacrylate, butyl methacrylate, ethyl acrylate, hydroxyethyl acrylate, butyl acrylate and 2-ethylhexyl acrylate, optionally together with one or more other polymerizable ethylenically unsaturated monomers including vinyl aromatic compounds such as styrene and vinyl toluene, nitriles such as acrylontrile and methacrylonitrile, vinyl and vinylidene halides, and vinyl esters such as vinyl acetate. Other suitable acrylics and methods for preparing the same are disclosed in U.S. Pat. No. 5,196,485 at column 11, lines 16–60, which are incorporated herein by reference.

Polyesters and alkyds are other examples of resinous binders useful for preparing the basecoating composition. Such polymers can be prepared in a known manner by condensation of polyhydric alcohols, such as ethylene glycol, propylene glycol, butylene glycol, 1,6-hexylene glycol, neopentyl glycol, trimethylolpropane and pentaerythritol, with polycarboxylic acids such as adipic acid, maleic acid, fumaric acid, phthalic acids, trimellitic acid or drying oil fatty acids.

Polyurethanes also can be used as the resinous binder of the basecoat. Useful polyurethanes include the reaction products of polymeric polyols such as polyester polyols or acrylic polyols with a polyisocyanate, including aromatic diisocyanates such as 4,4'-diphenylmethane diisocyanate, aliphatic diisocyanates such as 1,6-hexamethylene diisocyanate, and cycloaliphatic diisocyanates such as isophorone diisocyanate and 4,4'-methylene-bis(cyclohexyl isocyanate).

The liquid basecoating composition can comprise one or more volatile materials such as water, organic solvents and/or amines. The solids content of the liquid basecoating composition generally ranges from about 15 to about 60 weight percent, and preferably about 20 to about 50 weight percent.

The basecoating composition can further comprise one or more additives such as pigments, fillers, UV absorbers, rheology control agents or surfactants. Useful pigments and fillers include aluminum flake, bronze flakes, coated mica, nickel flakes, tin flakes, silver flakes, copper flakes, mica, iron oxides, lead oxides, carbon black, titanium dioxide and talc. The specific pigment to binder ratio can vary widely so long as it provides the requisite hiding at the desired film thickness and application solids.

Optional ingredients in the basecoat composition include those which are well known in the art of formulating surface coatings, such as surfactants, flow control agents, thixotropic agents, fillers, anti-gassing agents, organic co-solvents, catalysts, and other customary auxiliaries. Examples of these materials and suitable amounts are described in U.S. Pat. Nos. 4,220,679; 4,403,003; 4,147,769 and 5,071,904, which are incorporated herein by reference. The solids content of the basecoating composition generally ranges from 15 to 60 weight percent, and preferably 20 to 50 weight percent.

Suitable waterborne basecoats for color-plus-clear composites include those disclosed in U.S. Pat. Nos. 4,403,003;

5,401,790 and 5,071,904, which are incorporated by reference herein. Also, waterborne polyurethanes such as those prepared in accordance with U.S. Pat. No. 4,147,679 can be used as the resinous film former in the basecoat, which is incorporated by reference herein. Suitable film formers for organic solvent-based basecoats are disclosed in U.S. Pat. No. 4,220,679 at column 2, line 24 through column 4, line 40 and U.S. Pat. No. 5,196,485 at column 11, line 7 through column 13, line 22, which are incorporated by reference herein.

The thickness of the basecoating composition applied to the substrate can vary based upon such factors as the type of substrate and intended use of the substrate, i.e., the environment in which the substrate is to be placed and the nature of the contacting materials.

The basecoat compositions can be applied to the substrate by any conventional coating technique such as brushing, spraying, dipping or flowing, but they are most often applied by spraying. The usual spray techniques and equipment for air spraying, airless spray and electrostatic spraying in either manual or automatic methods can be used.

During application of the basecoat to the substrate, the film thickness of the basecoat formed on the substrate is typically 0.1 to 5 mils (about 2.54 to about 127 micrometers), preferably 0.1 to 2 mils (about 2.54 to about 50.8 micrometers).

After forming a film of the basecoat on the substrate, the basecoat can be cured or alternately given a drying step in which solvent is driven out of the basecoat film by heating or an air drying period before application of a clearcoat. Suitable drying conditions will depend on the particular basecoat composition, and on the ambient humidity if the composition is water-borne, but preferably, a drying time of from 1 to 15 minutes at a temperature of 75' to 200° F. (21° to 93° C.) will be adequate.

After the basecoat on the substrate has been set or dried (and cured and/or cooled, if desired), a clearcoat composition preferably is applied upon the dried basecoat. As used herein, the term "set" means that the liquid topcoating is tack-free (resists adherence of dust and other airborne contaminants) and is not disturbed or marred (waved or rippled) by air currents which blow past the topcoated surface.

The clearcoat can be liquid, powder slurry (powder suspended in a liquid) or powder (solid), as desired. Preferably, the clearcoat composition is a crosslinkable coating comprising one or more thermosettable film-forming materials and one or more crosslinking materials. Useful film-forming materials include epoxy-functional film-forming materials, acrylics, polyesters and/or polyurethanes, as well as thermoplastic film-forming materials such as polyolefins can be used. The clearcoat composition can include additives such as are discussed above for the basecoat, but preferably not pigments. If the clearcoat is a liquid or powder slurry, volatile material(s) are included.

Suitable waterborne topcoats are disclosed in U.S. Pat. No. 5,098,947 (incorporated by reference herein) and are based on water soluble acrylic resins. Useful solvent borne topcoats are disclosed in U.S. Pat. Nos. 5,196,485 and 5,814,410 and include epoxy-functional materials and polyacid curing agents. Suitable powder topcoats are described in U.S. Pat. No. 5,663,240 (incorporated by reference herein) and include epoxy functional acrylic copolymers and polycarboxylic acid crosslinking agents, such as dodecanedioic acid. The amount of the topcoating composition applied to the substrate can vary based upon such factors as the type of substrate and intended use of the substrate, i.e., the environment in which the substrate is to be placed and the nature of the contacting materials.

The transparent clearcoat composition is typically applied upon the basecoat by spray application, however, the clearcoat can be applied by any convenient coating technique. Any of the known spraying techniques can be used such as compressed air spraying, electrostatic spraying and either manual or automatic methods. As mentioned above, the clearcoat can be applied to a cured or to a dried basecoat before the basecoat has been cured. In the latter instance, the two coatings are then heated to cure both coating layers simultaneously. Typical curing conditions range from 265° to 350° F. (129° to 175° C.) for 20 to 30 minutes. The clearcoating thickness (dry film thickness) is typically 1 to 6 mils (about 25.4 to about 152.4 micrometers).

During application of the clearcoat composition to the substrate, ambient relative humidity generally can range from about 30 to about 80 percent, preferably about 50 percent to 70 percent.

In an alternative embodiment, after the basecoat is applied (and cured or set, if desired), multiple layers of transparent ("clear") coatings can be applied upon the basecoat. This is generally referred to as a "clear-on-clear" application.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

What is claimed is:

1. A method of coating a metallic article having a Class A surface and a non-Class A surface, comprising the steps of:

applying a zinc-containing electroconductive epoxy resin containing material over at least a portion of the Class A and non-Class A surfaces;

electrodepositing a primer-surfacer upon at least a portion of the zinc-containing material on the Class A surface; and electrodepositing an anticorrosion material upon at least a portion of the zinc-containing material on the non-Class A surface, wherein the primer-surfacer comprises less than 5 weight percent powder material.

2. The method according to claim 1, including setting the primer-surfacer before depositing the anticorrosion material.

3. The method according to claim 1, including depositing a basecoat upon the primer-surfacer.

4. The method according to claim 3, including setting the basecoat.

5. The method according to claim 4, including applying a clearcoat upon the basecoat.

6. The method according to claim 5, including setting the clearcoat.

7. The method according to claim 6, including curing any curable components of the primer-surfacer, basecoat, or clearcoat.

8. A method of coating a metallic article having a Class A surface and a non-Class A surface, comprising the steps of:

applying a zinc-containing electroconductive epoxy resin containing material over at least a portion of the Class A and non-Class A surfaces;

electrodepositing a primer-surfacer upon at least a portion of the zinc-containing material on the Class A surface; and electrodepositing an anticorrosion material upon at least a portion of the zinc-containing material on the non-Class A surface, wherein the primer-surfacer comprises a crosslinkable film forming material selected from the group consisting of polyurethanes, polyesters and acrylic polymers.

9. The method according to claim 8, including setting the primer-surfacer before depositing the anticorrosion material.

10. The method according to claim 9, including depositing a basecoat upon the primer-surfacer.

11. The method according to claim 10, including setting the basecoat.

12. The method according to claim 11, including applying a clearcoat upon the basecoat.

13. The method according to claim 12, including setting the clearcoat.

14. The method according to claim 13, including curing any curable components of the primer-surfacer, basecoat, or clearcoat.

* * * * *